US008056485B2

(12) United States Patent
Register et al.

(10) Patent No.: US 8,056,485 B2
(45) Date of Patent: Nov. 15, 2011

(54) RAIL CAR DOOR CLOSER

(75) Inventors: Carl A. Register, San Antonio, TX (US); Jason L. Register, San Antonio, TX (US); Jeffrey C. Register, San Antonio, TX (US)

(73) Assignee: Gates Management, Ltd., San Antonio, TX (US)

( * ) Notice: Subject to any disclaimer, the term of this patent is extended or adjusted under 35 U.S.C. 154(b) by 247 days.

(21) Appl. No.: 12/499,570

(22) Filed: Jul. 8, 2009

(65) Prior Publication Data

US 2010/0005999 A1 Jan. 14, 2010

Related U.S. Application Data

(60) Provisional application No. 61/079,302, filed on Jul. 9, 2008.

(51) Int. Cl.
*B61D 7/00* (2006.01)

(52) U.S. Cl. ..... 105/241.2; 105/286; 105/288

(58) Field of Classification Search ..... 105/247, 105/248, 240, 284, 287, 288, 289, 290, 286, 105/296, 299, 241.2; 414/372, 376, 377, 414/378; 104/162, 252, 253; 188/38, 38.5; 238/2, 3

See application file for complete search history.

(56) References Cited

U.S. PATENT DOCUMENTS

| | | | | |
|---|---|---|---|---|
| 4,011,956 | A | 3/1977 | Green et al. | |
| 4,120,412 | A | 10/1978 | Miller et al. | |
| 4,508,037 | A | 4/1985 | Rousseau | |
| 4,829,908 | A | 5/1989 | Hallam | |
| 4,843,974 | A | 7/1989 | Ritter et al. | |
| 5,249,531 | A | 10/1993 | Taylor | |
| 5,299,508 | A | 4/1994 | Connelly | |
| 5,302,072 | A | 4/1994 | Stauffer et al. | |
| 5,359,942 | A | 11/1994 | Ward | |
| 5,419,262 | A | 5/1995 | Turpin, Sr. | |
| 5,601,032 | A | 2/1997 | Kosch | |
| 5,606,916 | A * | 3/1997 | Murray | 105/286 |
| 6,431,084 | B1 | 8/2002 | Gaydos | |
| 6,886,473 | B2 | 5/2005 | Marchiori et al. | |
| 7,051,660 | B2 * | 5/2006 | Insana et al. | 104/162 |
| 7,063,022 | B1 | 6/2006 | Marchiori et al. | |
| 7,178,464 | B2 | 2/2007 | Clark | |
| 7,178,465 | B1 | 2/2007 | Marchiori et al. | |
| 7,559,283 | B2 * | 7/2009 | Clark | 105/241.2 |

* cited by examiner

*Primary Examiner* — Mark Le
(74) *Attorney, Agent, or Firm* — Gunn, Lee & Cave, P.C.

(57) ABSTRACT

A rail car door closer is shown for hopper type rail cars used to carry bulk commodities or materials. Cylinders provide horizontal motion to rotate an axle on which cam closers are attached thereto. The cam closers operate between a relaxed position (down position) and a raised position (up position). During rotation of the cam closers from the relaxed position to the raised position, the cam closers push hopper doors under the rail car up to a latched position. Individual hopper doors can be closed, or multiple doors can be simultaneously closed, depending on the preference of the operator. The cylinders are protected from falling bulk commodities by an elongated tent frame structure.

9 Claims, 7 Drawing Sheets

RAIL CAR DOOR CLOSER

CROSS REFERENCE TO RELATED PATENTS

This application claims priority to provisional patent application Ser. No. 61/079,302 filed on Jul. 9, 2008 entitled "Rail Car Door Closer" by Carl A. Register.

BACKGROUND OF THE INVENTION

1. Field of the Invention

This invention relates to rail car door closures and, more particularly, to rail car door closures that are attached to opposite ends of a rotating axle with an actuating mechanism that is attached to and covered by an elongated main frame tent structure with cam closures for pressing against the rail car door to cause the rail car door to close during rotation of the axle.

2. Background of the Prior Art

Railroad cars are used to carry bulk commodities with the most common bulk commodity being coal to provide energy and power. Other bulk commodities may be grain, aggregate, phosphate or other similar type materials. The railroad car used to carry bulk commodities normally has hopper doors on the bottom thereof that swing downward when unloading. These hopper doors on the bottom of a railroad car typically weigh about 200-300 pounds each and are difficult to close manually even under ideal conditions. After a period of extended wear, the hopper doors may become bent or warped making the closing of the hopper doors manually even more difficult.

Over the years, numerous injuries to railroad workers have been involving the closing of the heavy hopper doors. The manual closing of the hopper doors takes two people under even ideal conditions. A warped, bent or worn hopper door becomes even more difficult to close.

U.S. Pat. No. 6,886,473 to Marchiori et al shows a type of rail car door closure having a chain drive or cable with a rotatable member attached thereto. By turning the rotatable member into the upper direction, followed by forward and reverse motion of the chain or cable, rail car doors are closed by force exerted against the door from the rotatable member. However, the system as shown in Marchiori et al has certain limitations involving primarily the installation and maintenance of the mechanism.

A different version of a door car opener and closer is shown in U.S. Pat. No. 7,063,022 to Marchiori et al that is a fairly complicated rail car door opener and closer combination. The opener portion is not applicable to the present invention and will only work on certain types of door locks. The system as shown in the '022 patent can only be installed at locations that provide enough clearance from the railroad track to install and operate the system.

Another type of rail car door closure is shown in U.S. Pat. No. 7,178,464 to Clarke. The system as shown in Clarke has a bell crank assembly which actuates arms that press against the hopper door to cause closure thereof.

U.S. Pat. No. 5,419,262 to Turpin, Sr. shows a railroad hopper car door closure with wheels mounted on the end of a pair of laterally extending arms to cause closure of the hopper doors. The system as shown in Turpin is located outside the railroad tracks and is not protected from falling bulk commodity.

SUMMARY OF THE INVENTION

It is an object of the present invention to provide a simple, safe, cost effective, but reliable, rail car door closure.

It is another object of the present invention to provide a rail car door closure that has an axle with a cam mounted thereon so that rotating the axle forces the cam against the rail car door forcing the rail car door up to the closed and locked position.

It is yet another object of the present invention to provide a rail car door closure that is operated by a pneumatic or hydraulic cylinder.

It is yet another object of the present invention to have a series of rail car door closures for simultaneously closing multiple hopper doors for a single railroad car simultaneously.

It is still another object of the present invention to provide multiple door closures for simultaneously closing hopper doors by rotation in one direction and, sequentially thereafter, closing mating hopper doors by a rotation of door closures in the opposite direction.

In the present invention, the actuated mechanisms of the rail car door closure is located between the railroad tracks at the place for dumping the bulk commodity. A tent type structure protects the actuating mechanism from falling bulk commodity. A pair of axles extend from the tent structure to either side thereof. On each end of the pair of axles are located closure arms.

A hydraulic cylinder is used to rotate a first axle and a first pair of closure alms on each end thereof. Sequentially thereafter, a second hydraulic cylinder rotates a second axle with a second pair of closure arms thereon. In this manner, a first hopper door is closed and then the mating hopper door (if there is one) is subsequently closed.

The actuation of the hydraulic cylinders is controlled by a control box. The hydraulic cylinders may be actuated in any manner desired depending upon the particular railroad car being unloaded and the hopper doors located thereon. This may vary from railroad car to railroad car.

Also, additional pairs of axles and closure arms can be included with additional pairs of hydraulic cylinders if more than one set of hopper doors are to be closed at one time. This varies according to the preference of the particular operator or the type railroad cars being unloaded.

The axles are supported by flange bearings attached to the tent type frame. The ends of the hydraulic cylinders are held in clevises. Keys and key ways are used to attach to the respective axles. A slotted connector arms provides for ease of connection of the cylinders to each axle to cause rotation movement thereof Also, the slotted converter arms may be quickly disconnected and removed for maintenance or repair.

DESCRIPTION OF THE PREFERRED EMBODIMENT

Figure 1:
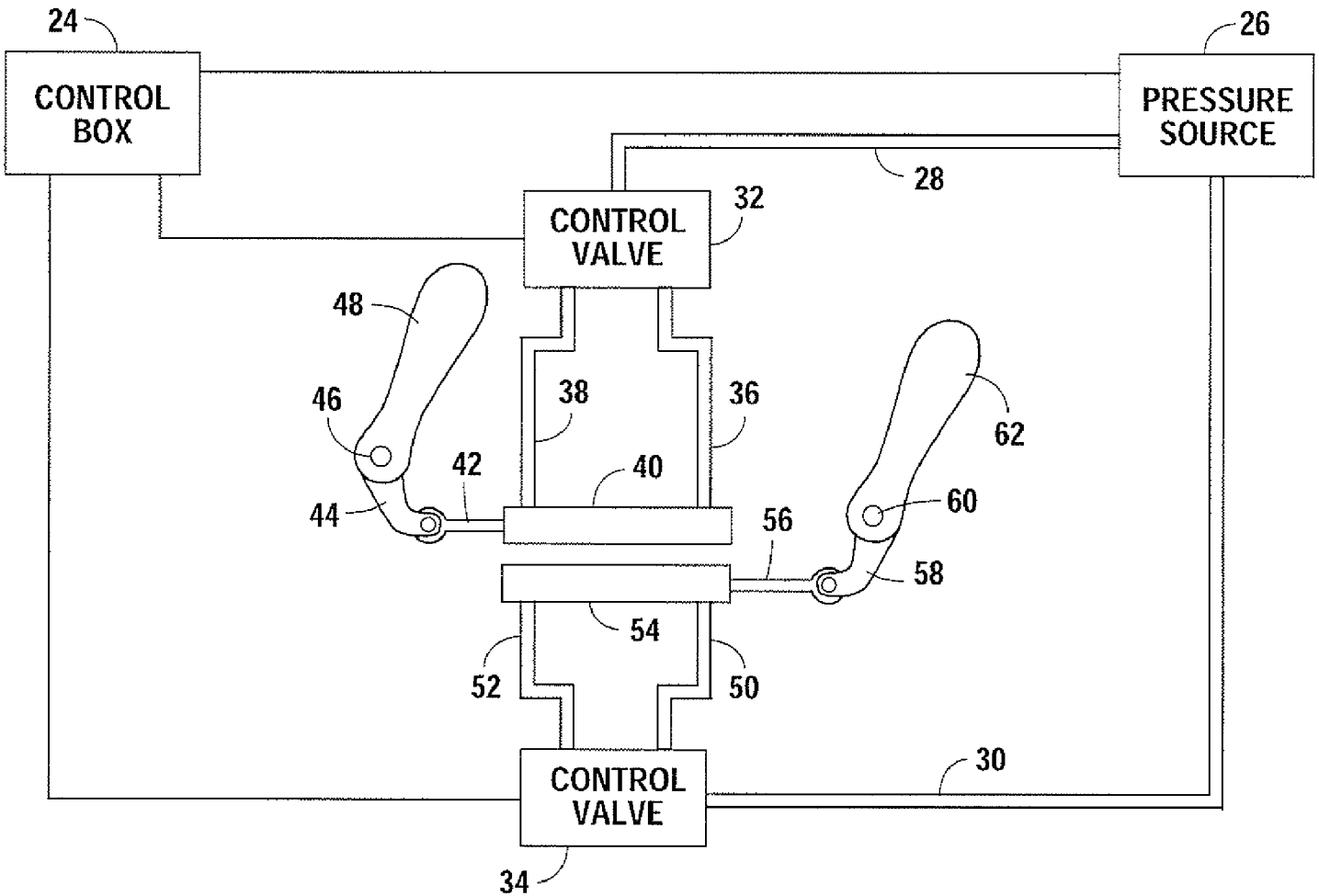
FIG. 1 is a pictorial block diagram of the controls for the rail car door closure showing the present invention.
Figure 2:
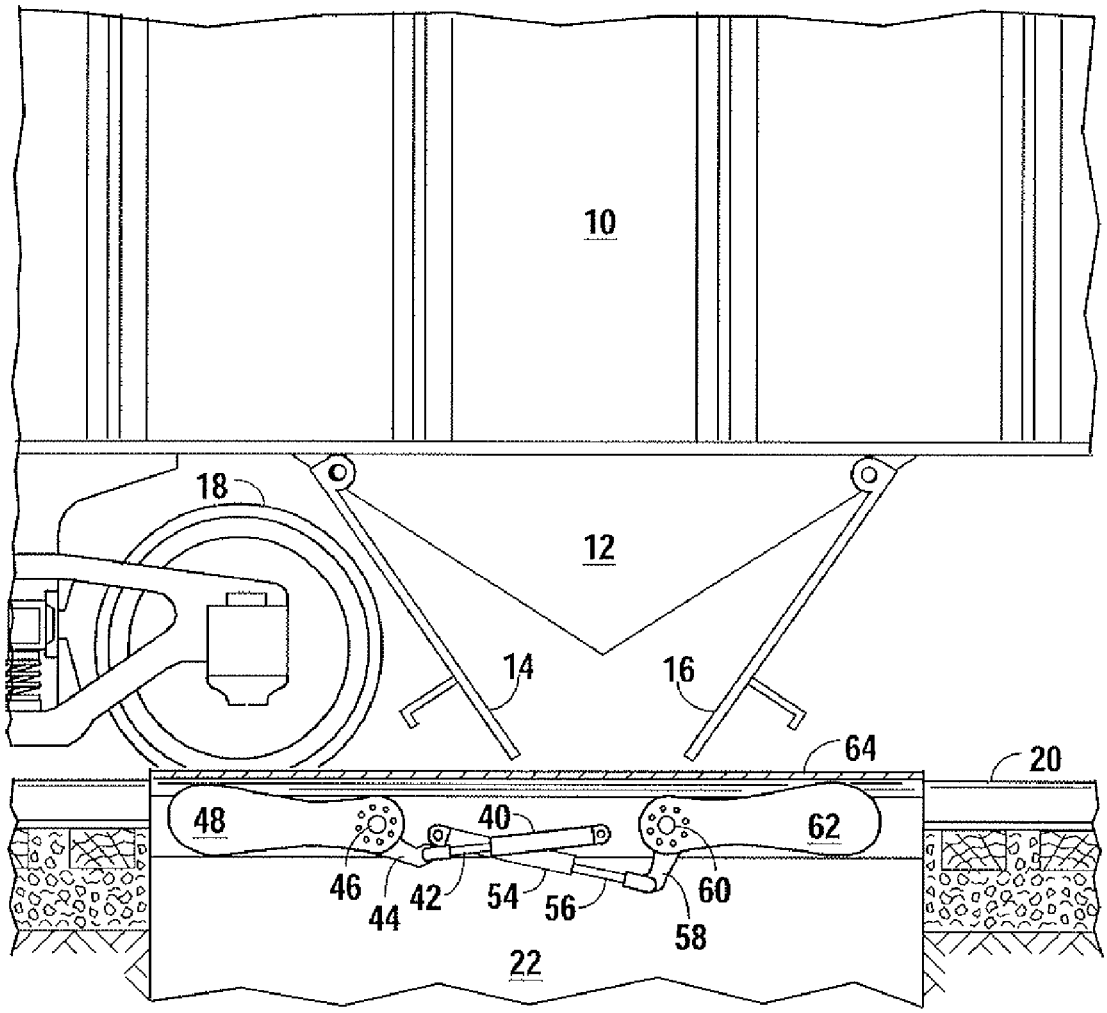
FIG. 2 is an elevated side view of the rail car door closure installed below a railroad car, but with the structure being cut away.

Referring to FIGS. 1 and 2 in combination, the rail car door closure system will be explained in further detail. A rail road car 10 that carries bulk commodities will typically have a hopper 12 at the bottom thereof that may be closed by hopper doors 14 and 16 hinged thereto. The rail road car 10 is supported by flanged wheels 18 that run on railroad tracks 20. A space 22 is provided below the hopper 12 into which a bulk commodity (not shown) being hauled in the railroad car 10 can be dumped. Across the space 22, the railroad tracks 20 can be supported by suitable structural support such as I beams (not shown).

Located adjacent to the railroad tracks 20 as shown in FIG. 1 is a control box 24 and a pressure source 26 to provide pressurized fluid or hydraulics. From the pressure source 26, pressurized fluid is provided by hydraulic lines 28 and 30 to control valves 32 and 34, respectively. Control valve 32 provides hydraulic fluid via hydraulic lines 36 and 38 to and from first hydraulic cylinder 40.

Extending from the first hydraulic cylinder 40 is a first hydraulic cylinder arm 42 that connects to a first slotted connector arm 44. Because the first slotted connector arm 44 is rigidly connected to first axle 46, as the first hydraulic cylinder arm 42 extends or contracts, first slotted connector arm 44 extends or contracts and hence rotates first axle 46. On each end of first axle 46 are located first cam closures 48. As the first axle 46 rotates, first cam closures 48 will also rotate because they are rigidly attached to the first axle 46.

Referring now to control valve 34, hydraulic lines 50 and 52 provide hydraulic fluid to and from second hydraulic cylinder 54. Second hydraulic cylinder 54 extends second hydraulic cylinder arm 56 that is pivotally connected to a second slotted connector arm 58. Because the second slotted connector arm 58 is rigidly connected to second axle 60, second axle 60 rotates as the second slotted connector arm 58 rotates due to action of the second hydraulic cylinder arm 56.

On each end of second axle 60 is located second cam closures 62. The second cam closures are rigidly attached to each end of second axle 60 so that as second axle 60 rotates, second cam closures also rotate.

Referring now to FIG. 2, the first cam closure 48 and second cam closures 62 are in the relaxed position. First hydraulic cylinder 40 and second hydraulic cylinder 54 are likewise relaxed so that first hydraulic cylinder arm 42 and second cylinder arm 56 are not extended, but are in their full relaxed state. However, upon activation of first hydraulic cylinder 40, first hydraulic cylinder arm 42 extends causing rotation about the first axle 46. Likewise, when second hydraulic cylinder 54 is activated and second hydraulic cylinder arm 56 is extended, rotation will occur second axle 60.

While cut away for illustration purposes, a tent frame structure 64 protects the first hydraulic cylinder 40 and second hydraulic cylinder 54 from falling bulk commodities or material.

Figure 3:
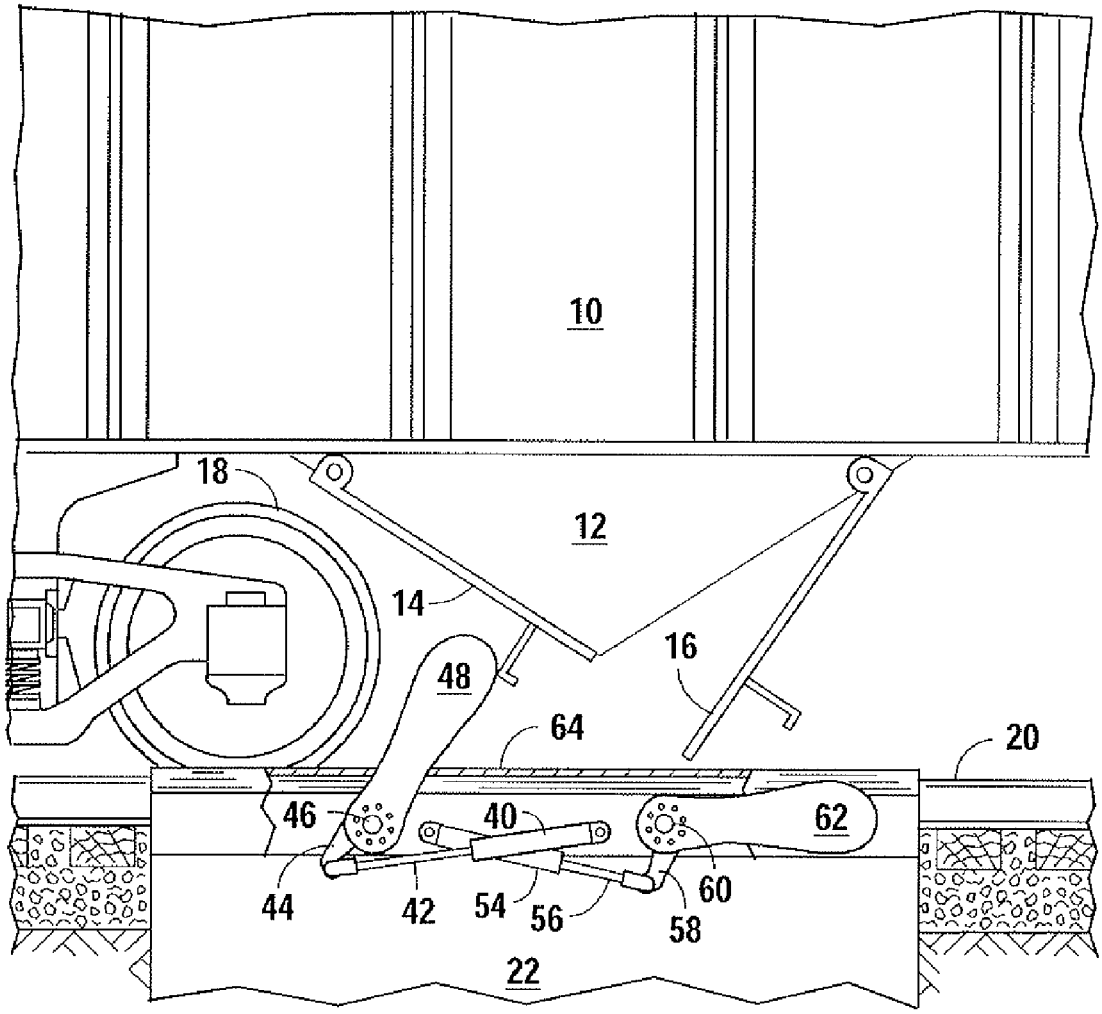
FIG. 3 is a sequential view of FIG. 2.
Figure 4:
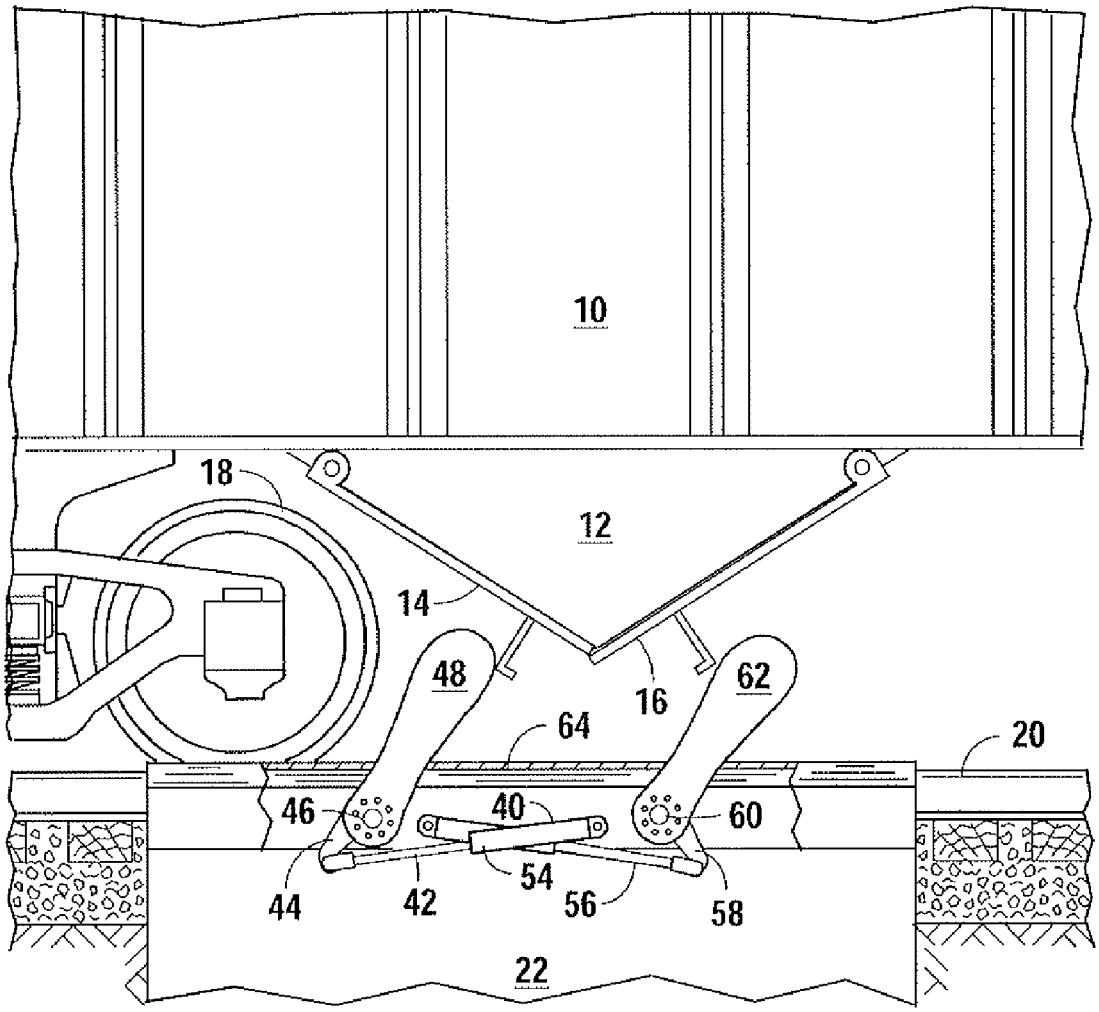
FIG. 4 is a sequential view of FIGS. 2 and 3.

Referring now to FIGS. 3 and 4 in sequence, FIG. 3 illustrates first hydraulic cylinder 40 has been activated via control valve 32 (see FIG. 1) so that first hydraulic cylinder arm 42 is extended. The first hydraulic cylinder arm 42 pushes against one end of the first slotted connector arm 44 which causes rotation of the first axle 46. Rotation of the first axle 46 rotates the first cam closures 48 on either end thereof which presses against hopper door 14 pushing it into a closed position.

While many different types of latches are used to maintain hopper doors on railroad cars in a closed position, a typical such lock is a Wine door lock that is commonly used in the industry. Other types of door latches are also used. The particular door latches are not shown, but when hopper door 14 is pushed against the hopper 12 as shown in FIG. 3, the door latch (not shown) will hold the hopper door 14 in the closed position.

Referring now to FIG. 4, after the hopper door 14 has been closed, second hydraulic cylinder 54 is activated by control valve 34 (see FIG. 1) so that second hydraulic cylinder arm 56 is extended. As second hydraulic cylinder arm 56 extends, it causes second slotted connector arm 58 to rotate causing pivotal rotation of second axle 60 to which it is connected. Rotation of second axle 60 pivots the cam closure 62 on either end thereof to press against the hopper door 16 and push hopper door 16 to the closed position. Hopper door 16 on the hopper 12 as illustrated in FIG. 4 overlaps hopper door 14. Therefore, hopper door 14 must be closed first and hopper door 16 closed second. Again, while the particular latching mechanism is not shown, a Wine door lock which is common in the industry could be used to hold hopper doors 14 and 16 in the closed position.

Figure 5:
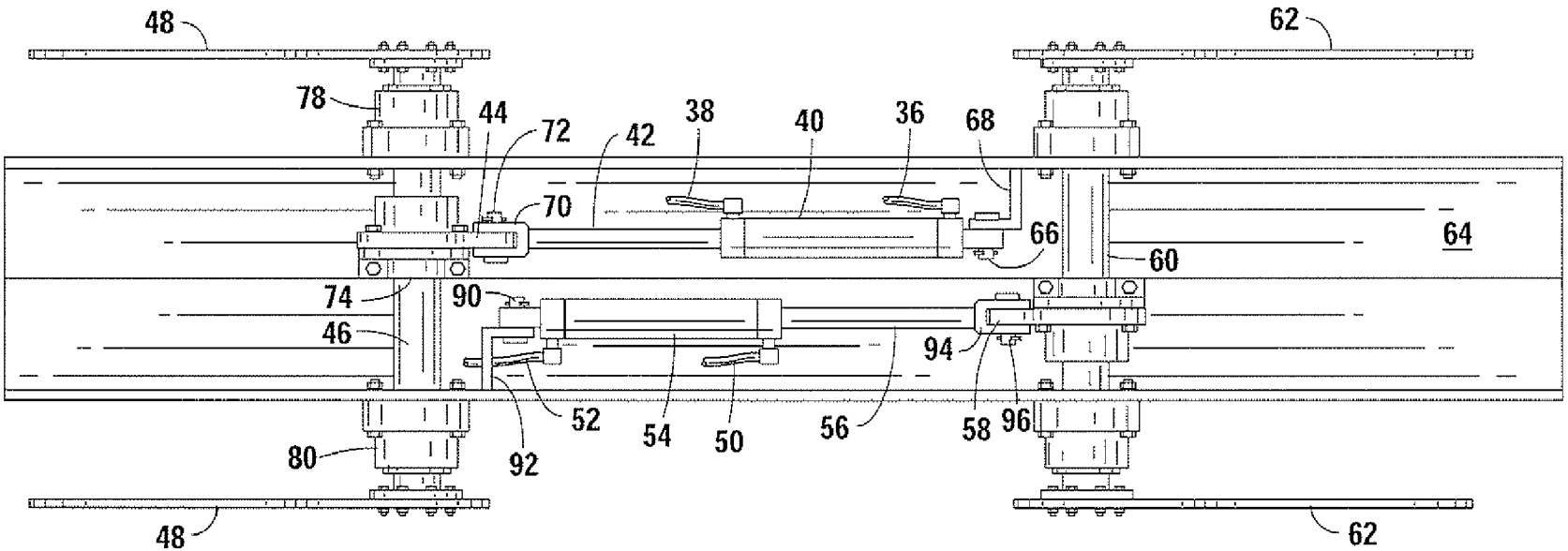
FIG. 5 is a bottom view of the rail car door closure.
Figure 6:
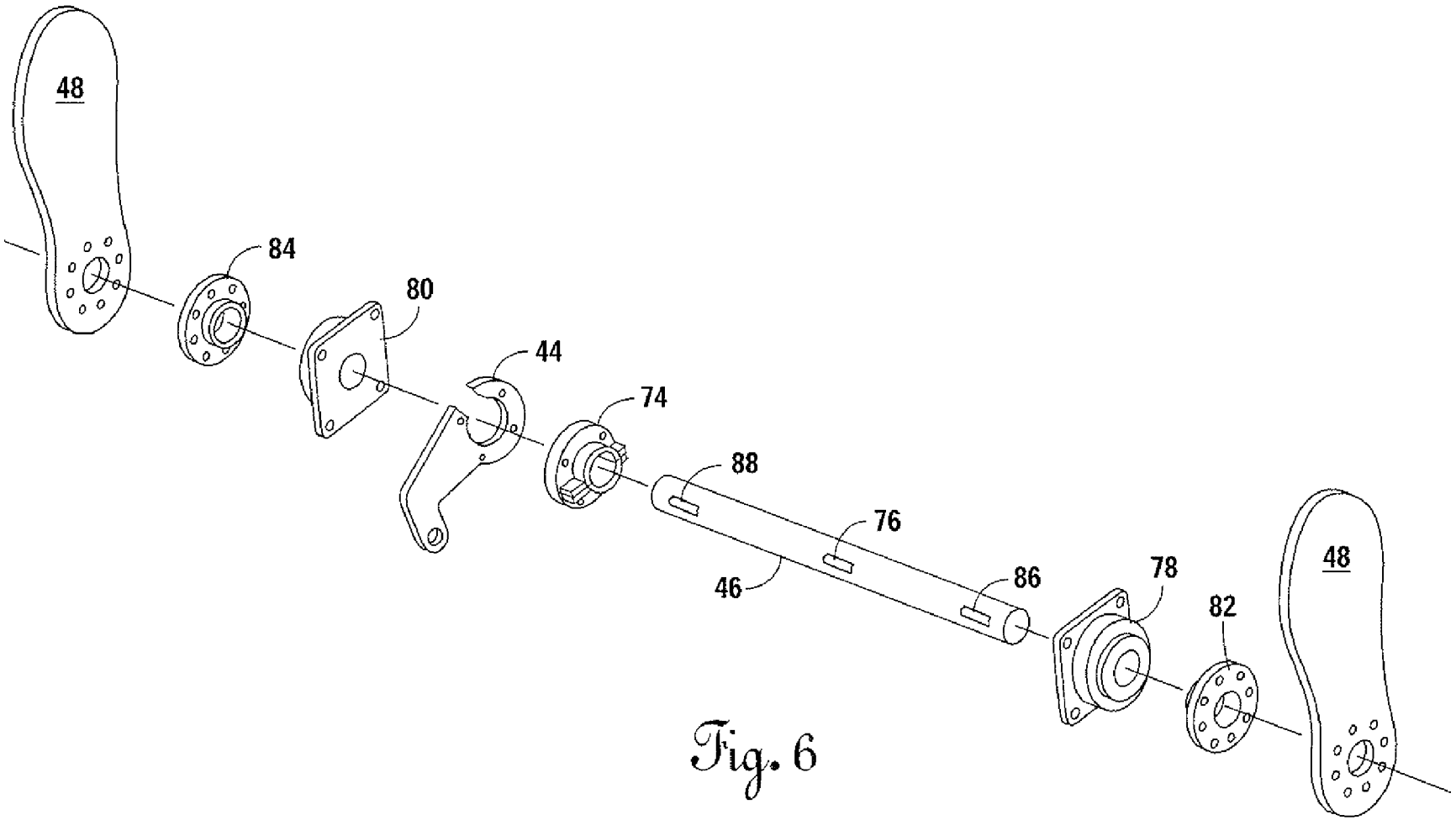
FIG. 6 is an explotive perspective view of one axle of the rail car door closure.

Referring now to FIG. 5 and 6 in combination, the hydraulic control portion of the present invention will be explained in further detail. FIG. 5 is a bottom view of the hydraulic control portion as shown in FIG. 2. The tent frame structure 64 which is an elongated tent shape extends over first hydraulic cylinder 40 and second hydraulic cylinder 54. For purposes of illustration, hydraulic lines 36 and 38 are cut away from hydraulic cylinder 40 and hydraulic lines 50 and 52 are cut away from second hydraulic cylinder 54.

Referring to first hydraulic cylinder 40, it is attached by clevis pin 66 to mounting bracket 68 so that the first hydraulic cylinder 40 can rotate about the clevis pin 66. As the first hydraulic cylinder 40 receives hydraulic fluid thereto, the first hydraulic cylinder arm 42 is extended. A shackle 70 on the end of first hydraulic cylinder arm 42 connects via clevis pin 72 to the first slotted connector arm 44. The first slotted connector arm 44 is rigidly attached to first axle 46 with axle clamp 74 (see FIG. 6). Axle clamp 74 has a suitable set screw (not shown) for connecting into slot 76 of first axle 46. By bolting the first slotted connector arm 44 to the axle clam 74, rotation of the first slotted connector arm 44 will cause rotation of first axle 46.

Mounted on either side of the tent frame structure 64 are flange bearings 78 and 80. The first axle 46 extends through holes (not shown) in tent frame structure 64 and through flange bearings 78 and 80. The flange bearings 78 and 80 are used to provide support for the rotation of first axle 46.

Mounted on each end of the first axle 46 are the first cam closures 48 which are bolted to retaining rings 82 and 84. Retaining rings 82 and 84 are secured to first axle 46 by means of set screws (not shown) that connect into retaining ring slots 86 and 88, respectively of first axle 46. The retaining ring slots 86 and 88 will prevent the first cam closures 48 from working their way off of the first axle 46.

While not shown in detail, the second axle 60 operates the same as the first axle 46 shown in the exploded perspective view of FIG. 6, but rotates in the opposite direction. When second hydraulic cylinder 54 is activated by control valve 34, second hydraulic cylinder arm 56 is extended. One end of second hydraulic cylinder 54 is held into position by clevis pin 90 pivotally attached to mounting bracket 92. On the far end of second hydraulic cylinder arm 56 is a shackle 94 through which clevis pin 96 pivotally attaches to the second slotted connector arm 58. Since the rotation of the second axle 60 via the second slotted connector arm 58 is essentially the same as that previously described for first axle 46 and illustrated in FIG. 6, it will not be covered in further detail herein. The rotation of the second axle 60 will rotate the second cam closures 62 secured to either end thereof.

Figure 7:
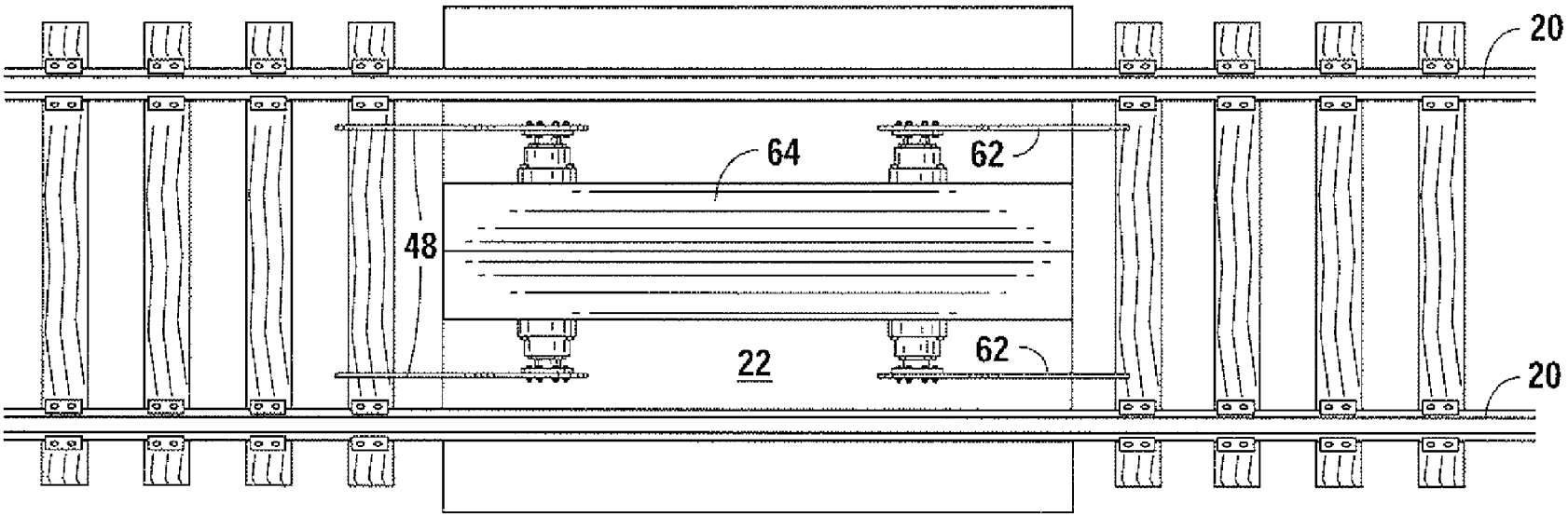
FIG. 7 is a top view of the rail car door closure as installed.

Referring now to FIG. 7 an overhead view of the present invention is illustrated with the railroad car 10 removed. The railroad tracks 20 extend over the space 22 into which the bulk material is dumped. I-beams or other support may be provided across this space 22 to support the railroad tracks 20.

Located between the railroad tracks 20 is the tent frame structure 64 which deflects the bulk material such as coal or other aggregates from hitting the first hydraulic cylinder 40 or the second hydraulic cylinder 54 (not visible in FIG. 7) as the bulk material falls into space 22. To close the hopper doors of any railroad car that may be moved above space 22 and the material dumped therein, first cam closures 48 will be rotated upward against the hopper door. After closing the first hopper door, then if the railroad car has a second hopper door, it will be closed by rotating upward the second cam closures 62. By use of the invention as just described, many different types of hopper doors for railroad cars can be closed. If it is a single door hopper, then the appropriate cam closures 48 or 62 will be rotated upward by the operator pushing the appropriate buttons (not shown) in a control box 24.

By use of the rail car door closure as described in the present invention, it is not critical that the railroad car be in the exact location. The railroad car can be off by a foot or two and still be closed by use of the present invention.

While the present invention is illustrated with a single set of hopper doors for a railroad car, most railroad cars have multiple sets of hopper doors. In such case, additional sets of hydraulic cylinders and cam closures could be added for each additional set of hopper doors. For the purposes of simplicity, the present invention was illustrated with only one set of hopper doors. However, it could equally be utilized with multiple sets of dual hopper doors or multiple sets of single door hoppers.

The present invention has everything located below the railroad tracks except the control box that can be operated to the side thereof, or to any other location that may be desired by the person unloading the railroad cars. The present invention is very durable and can be utilized with all types of bulk materials or aggregates regardless of how abrasive or dusty.

We claim:

1. A rail car door closer system mounted between railroad tracks and over an unloading space for unloading bulk materials from rail cars with hopper doors at the bottom thereof, said rail car door closer system comprising:

an elongated tent frame structure between said railroad tracks, said elongated tent frame structure being of a configuration to deflect said bulk materials;

linear actuator protected by said elongated tent frame structure and mounted thereunder, axles rotatably connected to said linear actuator and substantially perpendicular thereto, said axles rotating upon operating of said linear actuator, said axles are mounted substantially perpendicular to an elongated axis of said elongated tent frame structure, at least one end of said axles extending from an underside of and through said elongated tent frame structure; and cam closure attached to said at least one end of said axles;

a relaxed position of said cam closure being when said cam closure is down, a raised position of said cam closure being when said cam closure is raised by said linear actuator rotating said axles and said cam closure presses against said hopper door to cause closing thereof.

2. The rail car door closure system as given in claim 1 wherein multiple linear actuators are used to rotate multiple axles to close multiple hopper doors.

3. The rail car door closure system as given in claim 2 includes at least one control box located remote from, but connected to, said linear actuators, said linear actuators being operated remotely from said control box.

4. The rail car door closure system as given in claim 3 wherein said linear actuators are hydraulic cylinders mounted under said elongated tent frame structure.

5. The rail car door closure system as given in claim 2 wherein said linear actuators are connected by clevis pins and shackle connections to allow motion therearound.

6. The rail car door closure system as given in claim 5 wherein said linear actuators are rotatably connected to said axles by slotted connector arms located therebetween.

7. The rail car door closure system as given in claim 1 wherein said axles are attached to said elongated tent frame structure by flange bearings.

8. The rail car door closure system as given in claim 7 wherein said axles are slotted for connection thereto.

9. The rail car door closure system as given in claim 1 wherein said cam closure is attached to both ends of said axles.

* * * * *